US008668557B2

(12) United States Patent
Batard et al.

(10) Patent No.: US 8,668,557 B2
(45) Date of Patent: Mar. 11, 2014

(54) OPTICAL GRADE SURFACING TOOL

(75) Inventors: Alain Batard, Charenton-le-Pont (FR); Jean-Etienne LePage, Charenton-le-Pont (FR)

(73) Assignee: Essilor International, Charenton le Pont (FR)

( * ) Notice: Subject to any disclaimer, the term of this patent is extended or adjusted under 35 U.S.C. 154(b) by 485 days.

(21) Appl. No.: 13/057,348

(22) PCT Filed: Sep. 4, 2009

(86) PCT No.: PCT/IB2009/006780

§ 371 (c)(1),
(2), (4) Date: Feb. 3, 2011

(87) PCT Pub. No.: WO2010/029404

PCT Pub. Date: Mar. 18, 2010

(65) Prior Publication Data

US 2011/0136415 A1 Jun. 9, 2011

(30) Foreign Application Priority Data

Sep. 10, 2008 (FR) ..... 08 56076

(51) Int. Cl.
*B24B 13/01* (2006.01)

(52) U.S. Cl.
USPC ..... 451/512; 451/921

(58) Field of Classification Search
USPC ..... 451/512, 921, 41–44
See application file for complete search history.

(56) References Cited

U.S. PATENT DOCUMENTS

| | | | | |
|---|---|---|---|---|
| 1,665,292 | A * | 4/1928 | Anderson et al. | 15/230.18 |
| 5,403,231 | A * | 4/1995 | Duckworth | 451/344 |
| 7,033,261 | B2 * | 4/2006 | Huguet | 451/490 |
| 7,223,164 | B2 * | 5/2007 | Bernard et al. | 451/490 |
| 7,559,829 | B2 * | 7/2009 | Stephane et al. | 451/512 |
| 2004/0072515 | A1 * | 4/2004 | Miyahara et al. | 451/285 |
| 2005/0101235 | A1 * | 5/2005 | Huguet | 451/512 |
| 2006/0154581 | A1 * | 7/2006 | Bernard et al. | 451/495 |
| 2008/0171502 | A1 * | 7/2008 | Stephane et al. | 451/512 |

FOREIGN PATENT DOCUMENTS

| | | | |
|---|---|---|---|
| FR | 2834662 | A1 | 7/2003 |
| FR | 2857610 | A1 | 1/2005 |
| FR | 2900356 | A1 | 11/2007 |
| WO | 2007128894 | A1 | 11/2007 |

OTHER PUBLICATIONS

International Search Report, dated Dec. 3, 2009, from corresponding PCT application.

* cited by examiner

*Primary Examiner* — Maurina Rachuba
(74) *Attorney, Agent, or Firm* — Young & Thompson

(57) ABSTRACT

Optical grade surfacing tool, including: a rigid support (60); an elastically compressible interface (12) attached to the rigid support (60); a flexible pad (13) adapted to be pressed against a surface (71) to be worked, attached to the interface (12) on the opposite side to the rigid support (60); and return spring elements (14) disposed between the rigid support (60) and a peripheral part (12*b*) of the interface (12); characterized in that the return spring elements (14) include a plurality of pairs of superposed elastically flexible blades (65, 66) that project transversely from the rigid support (60), respectively a first blade (65) having a distal portion cooperating in bearing engagement, through a first face, exclusively with the peripheral part (12*b*) of the interface (12), and a second blade (66) cooperating in bearing engagement with the first blade (65) via a second face opposite its first face.

17 Claims, 2 Drawing Sheets

OPTICAL GRADE SURFACING TOOL

FIELD OF THE INVENTION

The invention relates to optical grade surfacing, for surfaces such as a face of an ophthalmic lens, a camera lens, an instrument for observing distant objects or a semiconductor substrate.

Surfacing means any operation aiming to modify the state of a previously worked surface. It is a question in particular of polishing, grinding or fine grinding operations aiming to modify (reduce or increase) the roughness of the surface and/or to reduce undulation thereof.

TECHNOLOGICAL BACKGROUND

There is already known, in particular from French patent application 2 834 662, to which corresponds US patent application 2005/0101235, French patent application 2 857 610, to which corresponds US patent application 2006/0154581, and French patent application 2 900 356, to which corresponds international application WO 2007/128894, a tool for surfacing an optical surface, the tool including: a rigid support having a transverse end surface; an elastically compressible interface attached to the rigid support, including a central part that is in line with to said end surface of the rigid support and a peripheral part that is transversely beyond said end surface of the rigid support; a flexible pad adapted to be pressed against a surface to be worked, attached to the interface on the opposite side to the rigid support, including a central part that is in line with said end surface of the rigid support and a peripheral part that is transversely beyond said end surface of the rigid support; and return spring means disposed between said rigid support and the peripheral part of said interface, the combination of said peripheral part of the pad, said peripheral part of the interface and the return spring means forming means for stabilizing the tool during surfacing, said tool being adapted to perform surfacing essentially in said central part of the pad.

To reduce the roughness of the optical surface, the tool is brought into contact with the optical surface and a sufficient pressure of the tool is maintained on it so that, by deformation of the interface, the pad espouses the shape of the optical surface.

While spraying the optical surface with a fluid, it is driven in rotation relative to the tool (or vice-versa) and is swept by the tool.

The optical surface is generally driven in rotation, friction between it and the tool being sufficient to entrain the tool so that it rotates with it.

The surfacing operation necessitates an abrasive that can be contained in the pad or in the fluid.

During surfacing, the interface, which is elastically compressible, compensates the curvature difference between the end surface of the tool support and the optical surface.

The results achieved by these tools are generally satisfactory, but it is sometimes difficult to avoid certain defects of appearance, namely the orange skin effect and the sheeplike effect.

To remedy these appearance defects, a flexible pad having a diameter larger than that of the interface so that the pad has an annular portion projecting transversely beyond the interface has already been proposed.

The resulting tool achieves an improvement in surface appearance, but in some circumstances such appearance defects remain.

Object of the Invention

The invention aims to provide a surfacing tool of particularly high performance in terms of minimizing appearance defects, in particular but not exclusively for surfaces to be worked that are convex.

To this end it proposes an optical grade surfacing tool including: a rigid support having a transverse end surface; an elastically compressible interface attached to the rigid support, including a central part that is in line with said end surface of the rigid support and a peripheral part that is transversely beyond said end surface of the rigid support; a flexible pad adapted to be pressed against a surface to be worked, attached to the interface on the opposite side to the rigid support, including a central part that is in line with said end surface of the rigid support and a peripheral part that is transversely beyond said end surface of the rigid support; and return spring means disposed between said rigid support and the peripheral part of said interface, the combination of said peripheral part of the pad, said peripheral part of the interface and the return spring means forming means for stabilizing the tool during surfacing, said tool being adapted to perform surfacing essentially in said central part of the pad; characterized in that said return spring means include a plurality of pairs of superposed elastically flexible blades that project transversely from the rigid support, respectively a first blade having a distal portion cooperating in bearing engagement, through a first face, exclusively with said peripheral part of the interface, and a second blade cooperating in bearing engagement with the first blade via a second face on the opposite side to its first face.

The blades of the various pairs exert a force on the peripheral part of the interface that is particularly favorable with regard to both the general conformation of the tool and its capacity to deform to follow variations in the altitude of the surface to be worked when the latter surface is globally convex, including when it exhibits large altitude variations, as is the case when it is one of the faces of an eyeglass lens adapted to correct the vision of a wearer suffering from presbyopia, myopia and astigmatism.

Because the return force is produced by two superposed blades, adopting an appropriate conformation of the distal portions of the blades makes it possible in particular to achieve flexible, progressive and continuous damping of deformations.

According to features preferred for being favorable to the quality of the cooperation of the blades with the rest of the tool and/or with each other:

- said first blade of each of said pairs is flat;
- said second blade of each pair has a distal portion curved toward the associated first blade;
- said distal portion is curved in a rounded loop such that the end of the second blade is turned towards said rigid support;
- said distal portion of said first blade and a distal portion of said second blade of each of said pairs are provided with longitudinal guide means;
- said first blade of each of said pairs has a length such that it extends transversely beyond said interface; and/or
- said return spring means are formed by a first star-shaped part and a second star-shaped part each of which includes a central annular part from which a plurality of branches project radially, the branches of the first star-shaped part forming said first blades and the branches of the second star-shaped part forming said second blades.

According to other features preferred for being simple, convenient and economical, whilst being favorable to the performance of the tool:

said rigid support includes a body and a head, said central part of the first star-shaped part and said central part of the second star-shaped part being clamped between said body and said head;

said rigid support is part of a base including a flexible collar around said support, said elastically compressible interface being pressed against and covering an end surface of said collar located on the same side as said end surface; and/or said base includes a rigid core having a transverse end surface and a flexible backing plate pressed against and covering said end surface, said rigid support being formed by said rigid core and a central part of said backing plate located in line with said transverse end surface of the core, said collar being formed by a peripheral part of said backing plate extending transversely beyond said end surface of said rigid core.

BRIEF DESCRIPTION OF THE DRAWINGS

The description of the invention continues now with the detailed description of embodiments of the invention given hereinafter by way of nonlimiting illustration and with reference to the appended drawings. In the drawings.

DETAILED DESCRIPTION OF EMBODIMENTS

Figure 1:
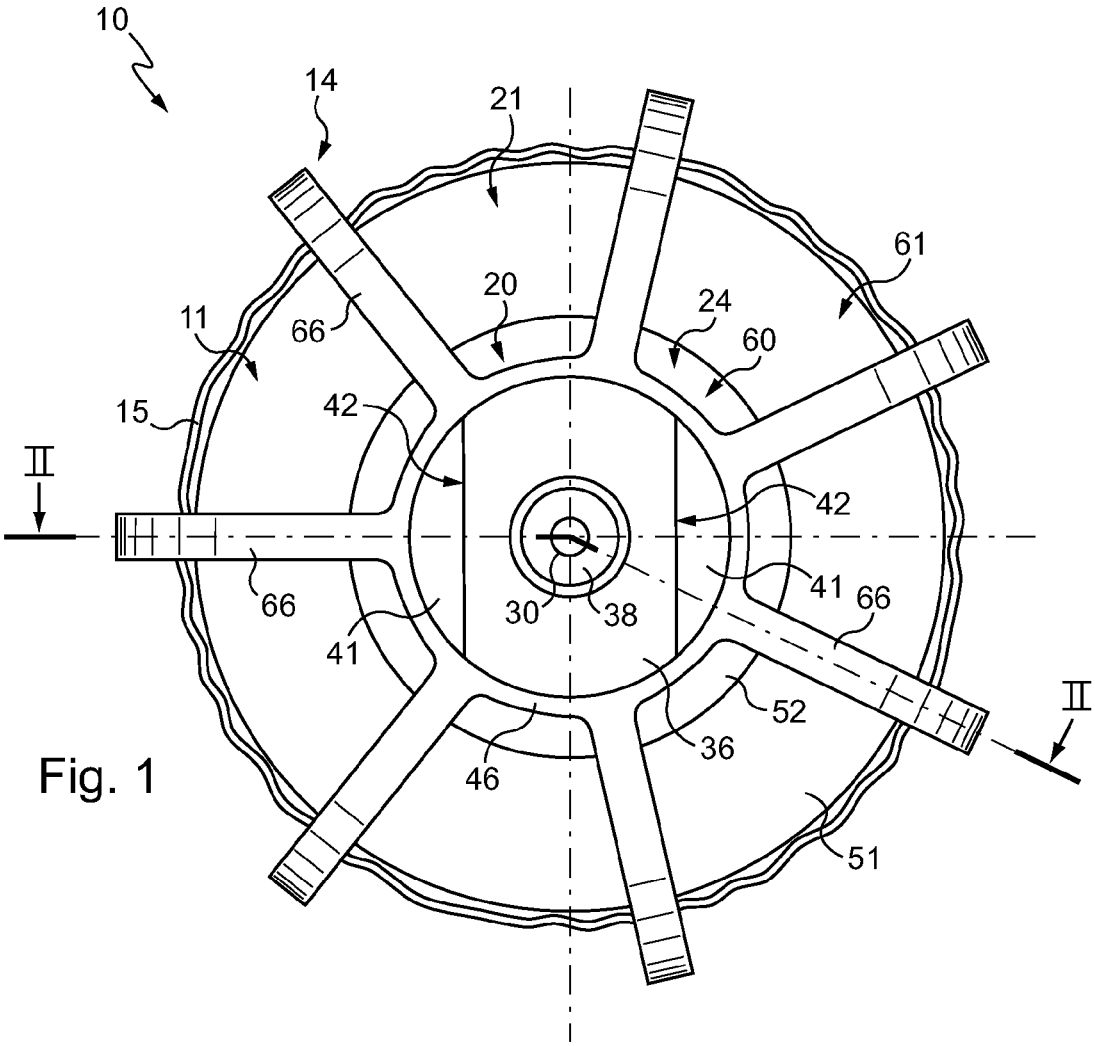
FIG. 1 is a plan view of a surfacing tool of the invention.

The tool 10 shown in the drawings includes a base 11, an elastically compressible interface 12 attached to the base 11, a flexible pad 13 attached to the interface 12 on the opposite side to the base 11, and return spring means 14 for the pad 13.

With the exception of two star-shaped parts 23 and that form the return spring means 14, the general shape of the tool 10 is that of a circular cylinder and the tool has an axis X of symmetry that defines a longitudinal direction.

The base 11 includes a rigid core 20 and a flexible backing plate 21. On the side seen at the bottom in FIG. 2, the base 11 has a transverse end surface 25.

Figure 2:
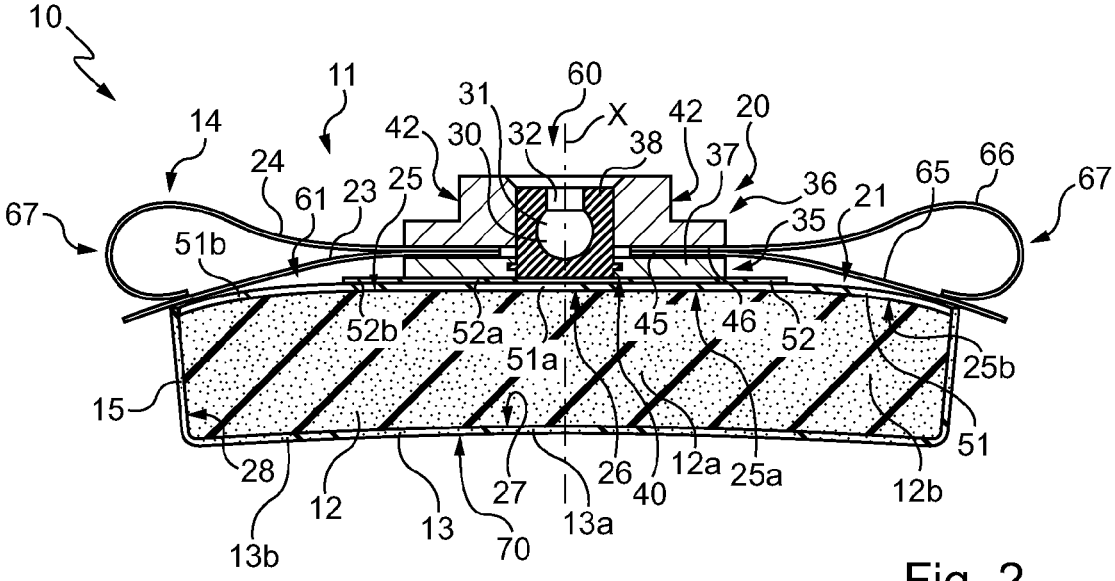
FIG. 2 is a view in section taken along the line II-II in FIG. 1.
Figure 3:
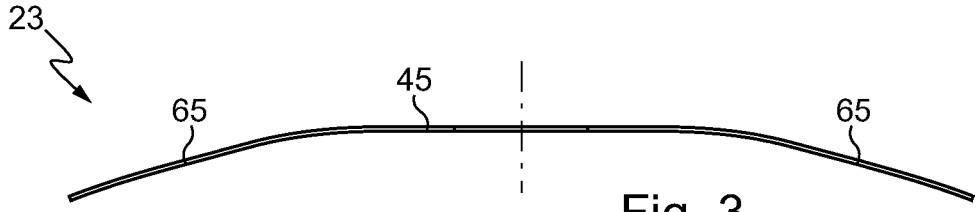
FIGS. 3 and 4 are respectively views in section taken along the same line as FIG. 2 of the first star-shaped part and the second star-shaped part of the tool.
Figure 4:
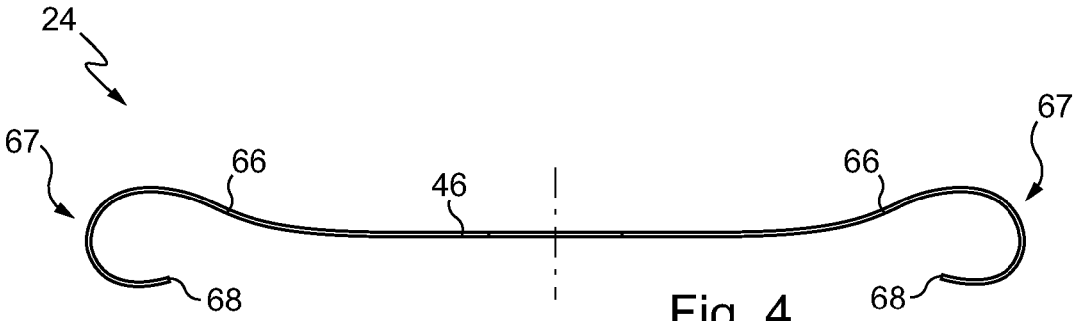

In the absence of stress, i.e. in a position that is not represented because the spring return means 14 act on the backing plate 21 including in the rest position shown in FIG. 2, the end surface 25 is plane.

The interface 12 has a first end surface 26, a second end surface 27 and a lateral surface 28 extending from the periphery of the surface 26 to the periphery of the surface 27.

In the absence of stress, i.e. in a position that is not shown, as explained above, the interface 12 and the pad 13 each have the general shape of a disk and have similar diameters, the thickness of the interface 12 being greater than the thickness of the pad 13.

The surface 26 of the interface 12 is pressed against and covers the surface 25 of the base 11.

The pad 13 is pressed against and covers the surface 27 of the interface 12.

Accordingly, the base 11 and the pad 13 are on opposite sides of the interface 12.

Here the pad 13 is extended by a flexible belt 15 that extends from the periphery of the pad 13 to the surface 26 of the interface 12.

The belt 15 and the pad 13 are produced from a disk of flexible material of uniform thickness, an annular peripheral strip of which is raised to form the belt 15.

The attachment of the base 11 and the interface 12 to each other is effected here by sticking them together over the whole of the surfaces 25 and 26.

The attachment of the interface 12 and the one-piece assembly formed by the pad 13 and the belt 15 is effected here by sticking together the whole of the surfaces 27 and 28 of the pad 13 and the belt 15.

The base 11 includes a cavity 30 opening onto the opposite side to the end surface 25 and extending in the longitudinal direction partway through the thickness of the base 11.

The cavity 30 is disposed centrally and is adapted for mounting the tool 10 on the head of the spindle of a surfacing machine.

The cavity 30 has a part-spherical portion 31 with the overall shape of three quarters of a sphere and a cylindrical portion 32 extending between the portion 31 and the opening of the cavity 30.

The spindle head adapted to be received into the cavity 30 includes a part-spherical end conformed like the portion 31 and a cylindrical portion of smaller diameter than the portion 32.

The base 11 and the spindle of the machine simply clip together, the material around the cylindrical portion 32 being deformable so that the spherical part of the head of the spindle can be housed in the portion 31.

When the spindle head is engaged in the cavity 30, the tool 10 cooperates with the spindle in the manner of a ball joint.

The cavity 30 is produced in the rigid core 20, which is described in more detail next.

The core 20 includes a body 35 and a head 36.

The body 35 includes an annular flange 37 and a threaded stud 38 projecting from the flange 37 on the side seen at the top in FIG. 2, the stud 38 being at the center of the flange 37.

The cavity 30 is produced in the stud 38.

The end surface 40 of the body 35 that is seen at the bottom in FIG. 2 is flat and continuous, the respective end surfaces of the flange 37 and the stud 38 being flush with each other.

Here the flange 37 is in practice of metal, for example steel, and the stud 38 is in practice of relatively rigid plastic material molded onto the flange 37. The stiffness of the stud 38 is chosen so that it cannot be deformed at the level of the surface 40 but can be deformed at the level of the cylindrical portion 32 to enable clipping of the spindle head into the cavity 30.

On its external lateral surface projecting from the flange 37, the stud 38 has a thread enabling it to cooperate with the threaded bore at the center of the head 36, which cooperates with the body 35 in the manner of a nut.

Here the head 36 has in practice a generally annular shape with the same outside diameter as the flange 37 and with two lateral cutaway portions 41 to expose two parallel flat faces 42 parallel to the axial or longitudinal direction X in order to enable the head 36 to be tightened and loosened relative to the flange 37 using a conventional wrench designed for turning nuts.

An annular central part 45 of the star-shaped part 23 and an annular central part 46 of the star-shaped part 24 are clamped between the body 35 and the head 36, the central parts 45 and 46 thus being secured rigidly to the core 20.

The backing plate 21 includes two superposed flexible discs 51 and 52.

In the absence of stress the discs 51 and 52 are generally circular, the diameter of the disc 51 is similar to that of the interface 12, and the diameter of the disc 52 is greater than the diameter of the core 20 or, to be more precise, the diameter of the body 35 of the core 20 is here less than the diameter of the interface 12.

The discs 51 and 52 are concentric with the remainder of the tool, and in particular concentric with the interface 12 and the core 20.

Here the discs 51 and 52 have a thickness similar to that of the pad 13.

The disc 52 is attached to the core 20 by sticking its transverse end surface, seen at the top in FIG. 2, to the whole of the surface 40.

The disc 51 is attached to the disc 52 by sticking its transverse end surface, seen at the top in FIG. 2, to the whole of the transverse end surface of the disc 52, seen at the bottom in FIG. 2.

The transverse end surface of the disc 51 seen at the bottom in FIG. 2 forms the transverse end surface 25 of the base 11.

Given the stiffness of the end surface 40 of the core 20 and the incompressibility of the discs 51 and 52 in the axial or longitudinal direction X, or in any event their very low compressibility compared to the compressibility of the interface 12, the central portions 51*a* and 52*a* of the discs 51 and 52 located in line with the end surface 40 can be considered rigid because they cannot bend like the peripheral portions 51*b* and 52*b*, which are transversely beyond the surface 40.

Thus the base 11 includes:

- a rigid support 60 formed by the core 20 and the central parts 51*a* and 52*a* of the discs 51 and 52, this rigid support having a transverse end surface corresponding to the central part 25*a* of the surface 25 situated in line with the end surface 40; and
- a flexible collar 61 formed by the peripheral parts 51*b* and 52*b* of the discs 51 and 52, this collar surrounding the rigid support 60, the elastically compressible interface 12 being pressed against and covering the end surface 25*b* of the collar 61 and the end surface 25*a* of the rigid support 60.

It will be noted that the elastically compressible interface 12 includes a central part 12*a* that is in line with the transverse end surface 40 or 25*a* and a peripheral part 12*b* that is transversely beyond the transverse end surface 40 or 25*a*.

Likewise, the flexible pad 13 includes a central part 13*a* that is in line with the end surface 40 or 25*a* and a peripheral part 13*b* that is transversely beyond the end surface 40 or 25*a*.

The spring return means 14 are disposed between the core 20 of the rigid support 60 and the peripheral part 12*b* of the interface 12, on which they act here via the flexible collar 61.

The combination of the peripheral part 13*b* of the pad 13, the peripheral part 12*b* of the interface 12, and the return means 14 forms means for stabilizing the tool 10 during surfacing (as explained in more detail later), the tool being adapted to perform surfacing essentially in the central part 13*a* of the pad 13.

The spring return means 14 are described in detail next.

They include a plurality of pairs of superposed, equi-angularly distributed and elastically flexible blades 65 and 66, of which there are seven here, which project transversely from the core 20 to bear on the peripheral part 12*b* of the interface 12, here via the flexible collar 61.

As a result, if a longitudinal force is exerted on the peripheral part 13*b* in line with the pair of blades and 66, the latter blades are deformed, exerting on the peripheral part 12*b* an opposite reaction force to that force.

In practice, as indicated above, the spring return means 14 are formed by the star-shaped parts 23 and 24 which include respective central annular parts 45 and 46 from which branches project radially, the branches of the part 23 forming the blades 65 and the branches of the part 24 forming the blades 66.

The star-shaped parts 23 and 24 are centered relative to the core 20 and more generally relative to the remainder of the tool 10.

As explained above, the annular central parts 45 and 46 are rigidly attached to the core 20 by clamping between the body 35 and the head 36.

Angular indexing of star-shaped parts 23 and 24 is performed so that their branches are superposed two by two to form the aforementioned pairs of blades.

The star-shaped part 23 is disposed on the same side as the interface 12 and the star-shaped part 24 is disposed on the opposite side of the interface 12 to the part 23.

Thus the blades 65 of the part 23 cooperate in bearing engagement with the peripheral part 12*b* of the interface 12, here via the flexible collar 61.

On the opposite side, i.e. on the side seen at the top in FIG. 2, the blades 65 cooperate in bearing engagement with the blades 66, here in direct bearing engagement.

To enable these two bearing engagements on its opposite faces, each blade 65 has, at least in a distal portion, a flat conformation that enables it to slide as much relative to the peripheral part 12*b* of the interface 12 as relative to the associated blade 66.

Here the blades 65 are in practice flat over the whole of their length.

Here the annular central part is oriented in a transverse plane and the blades 65 are inclined toward the interface 12.

It will be observed that the blades 65 have a length such that each extends transversely beyond the interface 12 and, here, the flexible belt 15.

The blades 66 of the star-shaped part 24 each have a distal portion 67 curved toward the associated blade 65 in a rounded loop such that the end 68 of the blade 66 is turned toward the core 20 of the support 60, the area of contact between the blades 65 and 66 being located short of the end 68.

Thanks to this conformation, the blades 65 and 66 can slide freely on each other when they are deformed, since the blade 66 is in contact with the flat distal portion of the blade 65 through a relatively flat area.

It will be seen that if the distal portion 67 had been conformed so that the end 68 is turned toward the blade 65, and thus if it were via the end 68 that the blade 66 were to bear on the blade 65, slipping between the two blades would occur in less good conditions because of the small area of contact offered by the area 68.

In practice, here, in the star-shaped part 24, the annular central part 46 is flat and oriented in a transverse plane and each blade 66 is first inclined away from the blade 65 and then curved toward the blade 65 over about one half-turn.

Figure 5:
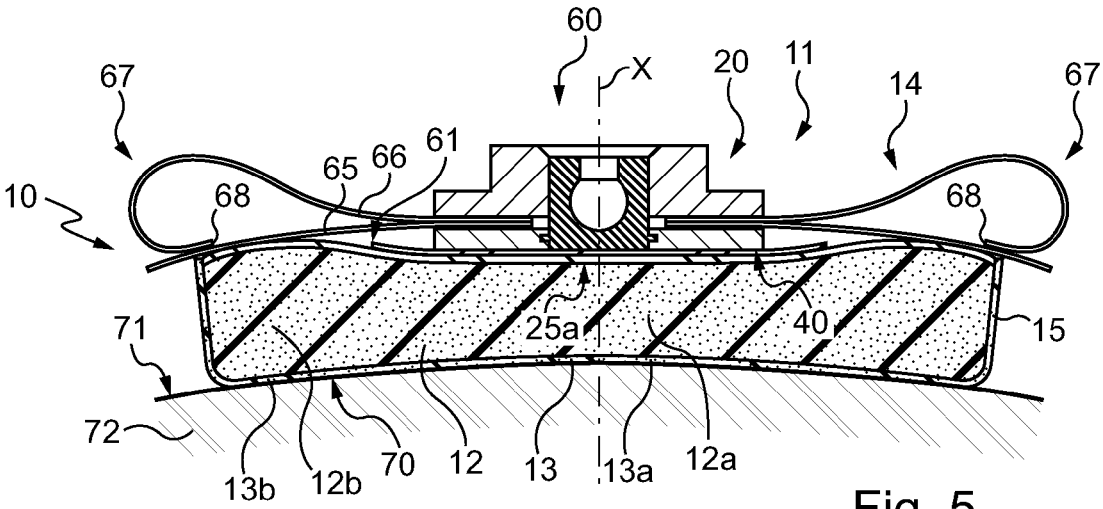
FIG. 5 is a view similar to FIG. 2, showing how the tool is deformed in contact with a convex surface to be worked.

As seen in FIGS. 2 and 5, here the area of contact between the blades 65 and 66 is substantially in line with the area of contact between the blade 65 and the peripheral part 12*b* of the interface 12, i.e. in the vicinity of the periphery of the interface 12.

The conformation of the blades 65 and 66, and more generally of the star-shaped parts 23 and 24, is such that in the absence of external stress (the situation shown in FIGS. 1 and 2), each blade 65 exerts on the periphery of the peripheral part 12*b* of the interface 12 a force directed towards that peripheral part, whereas the blade 66 exerts a force directed toward the blade 65, as a result of which the interface 12 assumes a conformation such that the surface 70 of the pad 13 adapted to come into contact with the surface to be worked is slightly concave.

When the tool 10 is pressed against a convex surface to be worked, such as the surface 71 shown in FIG. 5, the elastically compressible interface 12 is deformed to allow the surface 70 to espouse the surface 71.

It is seen that the interface 12 is strongly compressed in the central part 12*a* and that the force exerted by the blades 65 and 66 is useful for forcing the peripheral part 12*b* to deform so that the peripheral part 13*b* of the pad 13 remains in contact with the surface 71.

To effect surfacing, the lens 72 of which the surface 71 is part is mounted on a rotary support (not shown) and the tool 10 is pressed against the surface 71 with sufficient force for the pad 13 to espouse its shape.

Here the tool 10 is free to rotate while however being off-center relative to the optical surface 71.

The friction between the surface 71 to be worked and the pad 13 is sufficient to entrain the tool 10 in rotation about the axis X of symmetry and in the same direction as the lens 72.

The optical surface 71 is sprayed with a spray fluid that is either non-abrasive or abrasive according to whether the pad 13 exercises this function itself or not.

In order to sweep the whole of the optical surface 71, the tool 10 is moved during surfacing along a radial trajectory, the point of intersection of the axis X of the tool 10 with the optical surface 71 effecting a to-and-fro movement between two return points.

During surfacing, the fact that the blades 66 exert on the blades 65 a force directed toward the periphery of the interface 12 means that the tool 10 offers particularly good performance in terms of remaining in contact with the surface 71 to be worked, including when the latter surface features large variations in altitude, for example if it is one face of an eyeglass lens for correcting the vision of a wearer suffering from presbyopia, myopia and astigmatism.

Thanks to its rounded nature, the conformation of the distal portion 67 has the advantage of providing flexible, progressive and continuous damping, contributing to the good performance of the tool 10.

It will be noted that it would have been possible to conform the distal portion 67 not in a rounded manner but instead with a pleat that would serve as a hinge between two flat portions. Because with such a hinge the progressive and continuous character of the damping would be lost, such a conformation would perform less well.

The flat nature of the distal portion of the blade allows not only excellent cooperation in bearing engagement with the distal portion 67 of the associated blade 66 but also a distribution of the forces exerted on the peripheral part 12*b* of the interface 12 that is favorable to homogeneous deformation of the tool.

It will be noted that the presence of the collar 61 is also favorable to uniform distribution of the pressure exerted on the surface to be worked.

It will further be noted that the flexible belt 15 is also favorable to uniform distribution of the pressure.

Figure 6:
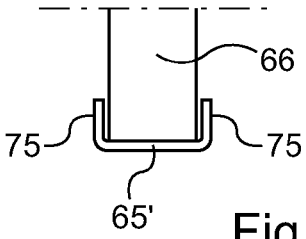
FIG. 6 is a partial view in section showing a variant of the distal portions of the blades.

FIG. 6 shows a variant 65' of the blade 65 which is provided with two raised longitudinal edges 75 in order to guide the blade 66 longitudinally to maintain indexing in the event of deformation.

In variants that are not shown, the guide means between blades like the blades 65 or 65' and 66 are different from the raised edges 75, for example a pin projecting from a blade like the blade 65 engaged in a groove of a blade like the blade 66.

In other variants that are not shown, in order to obtain optimum elastic bending characteristics, blades like the blades 65 or 65' and 66 of star-shaped parts like the star-shaped parts 23 and 24 have a width that is not constant but varies, for example progressively decreasing in size between a central part like the central part 45 or 46 and a narrower area and then progressively widening up to the distal end.

In other variants that are not shown, in order to optimize the characteristics of contact with the interface and the distribution of pressure, the distal portion of blades like the blades 65 or 65', cooperating in bearing engagement with a peripheral part like the peripheral part 12*b* of an interface like the interface 12, is conformed differently from the rest of the blade like the blade 65 or 65', for example being significantly wider or fork-shaped.

It will be observed that in the tool 10 shown the blades like the blades 65 or 65' have a distal portion that cooperates in bearing engagement with the peripheral part 12*b* of the interface 12 without being directly in contact with the interface 12, the collar 61 being disposed between blades like the blades 65 or 65' and the interface 12. Alternatively, blades like the blades 65 or 65' are in direct contact with the peripheral part of an interface like the interface 12.

In a variant that is not shown and gives good results when the surface to be worked is relatively simple (essentially toroidal or spherical), in which case it can produce excellent results for a relatively wide range of curvatures, blades like the blades 66 cooperate in bearing engagement with blades like the blades 65 or 65' not through direct contact but instead via a deformable ring disposed between the distal portions of the blades like the blades 66 and the distal portions of the blades like the blades 65 or 65'.

In variants of the tool 10 that are not shown, adapted to work a surface of more pronounced convexity than the surface 71, the end surface like the end surface 40 or 25*a* is not flat but instead concave; the interface like the interface 12 has an initial conformation curved in corresponding fashion but of uniform thickness; and/or the central parts like the central parts 45 and 46 of the star-shaped parts like the star-shaped parts 23 and 24 are frustoconical instead of flat, the surfaces between which the central parts are clamped being also frustoconical, of course.

In another variant that is not shown, the central parts like the central parts 45 and 46 of the star-shaped parts like the star-shaped parts 23 and 24 are not attached to the rigid support like the rigid support 60 by clamping between surfaces of parts screwed together concentrically like the body 35 and the head 36, but in some other way, for example by a plurality of screws each of which is screwed into a respective hole in the body like the body 35.

In a further variant that is not shown, the rigid support 60 and the collar 61 are replaced by a rigid support and a collar arranged differently, for example as described in French patent application 2 900 356, to which international application WO 2007/128894 corresponds, or there is no such collar.

In a further variant that is not shown, the belt like the belt 15 is conformed differently, for example with its opposite end to the pad like the pad 13 at a distance from the opposite end surface like the end surface 26, or there is no belt like the belt 15.

Numerous other variants are possible as a function of circumstances and in this respect it is pointed out that the invention is not limited to the examples described and shown.

The invention claimed is:

1. An optical grade surfacing tool, comprising:

a rigid support having a transverse end surface;

an elastically compressible interface attached to the rigid support, the elastically compressible interface including a central part which is in line with the end surface of the rigid support, and a peripheral part that is disposed transversely beyond the end surface of the rigid support;

a flexible pad configured to be pressed against a surface to be worked, attached to the interface on the opposite side to the rigid support, the flexible pad including a central part that is in line with the end surface of the rigid support, and a peripheral part that is disposed transversely beyond the end surface of the rigid support; and return spring means disposed between the rigid support and the peripheral part of the interface, the return spring means including a plurality of pairs of superposed elastically flexible blades that project transversely from the rigid support, a first of the blades having a distal portion cooperating in bearing engagement, through a first face, exclusively with the peripheral part of the interface, and a second of the blades cooperating in bearing engagement with the first blade exclusively via a second face of the distal portion on the opposite side to the first face, wherein the combination of the peripheral part of the pad, the peripheral part of the interface, and the return spring means forming means for stabilizing the tool during surfacing, the tool being configured to perform surfacing essentially in the central part of the pad.

2. The tool according to claim 1, wherein the distal portion of the first blade of each of the pairs is flat.

3. The tool according to claim 1, wherein the second blade of each pair has a distal portion curved toward the associated first blade.

4. The tool according to claim 3, wherein the distal portion of the second blade is curved in a rounded loop such that an end of the second blade is turned towards the rigid support.

5. The tool according to claim 1, wherein the distal portion of the first blade and a distal portion of the second blade of each of the pairs are provided with longitudinal guide means.

6. The tool according to claim 1, wherein the first blade of each of the pairs has a length such that the first blade extends transversely beyond the interface.

7. The tool according to claim 1, wherein the return spring means are formed by a first star-shaped part and a second star-shaped part each of which include a central annular part from which a plurality of branches project radially, the branches of the first star-shaped part forming the first blades and the branches of the second star-shaped part forming the second blades.

8. The tool according to claim 7, wherein the rigid support includes a body and a head, the central part of the first star-shaped part and the central part of the second star-shaped part being clamped between the body and the head.

9. The tool according to claim 1, wherein the rigid support is part of a base including a flexible collar around the support, the elastically compressible interface being pressed against and covering an end surface of the collar located on the same side as the end surface.

10. The tool according to claim 9, wherein the base includes a rigid core having a transverse end surface and a flexible backing plate pressed against and covering the end surface, the rigid support being formed by the rigid core and a central part of the backing plate located in line with the transverse end surface of the core, the collar being formed by a peripheral part of the backing plate extending transversely beyond the end surface of the rigid core.

11. The tool according to claim 2, wherein the second blade of each pair has a distal portion curved toward the associated first blade.

12. The tool according to claim 2, wherein the distal portion of the first blade and a distal portion of the second blade of each of the pairs are provided with longitudinal guide means.

13. The tool according to claim 2, wherein the first blade of each of the pairs has a length such that the first blade extends transversely beyond the interface.

14. The tool according to claim 2, wherein the return spring means are formed by a first star-shaped part and a second star-shaped part each of which include a central annular part from which a plurality of branches project radially, the branches of the first star-shaped part forming the first blades and the branches of the second star-shaped part forming the second blades.

15. The tool according to claim 2, wherein the rigid support is part of a base including a flexible collar around the support, the elastically compressible interface being pressed against and covering an end surface of the collar located on the same side as the end surface.

16. The tool according to claim 1, wherein the second blade cooperates in bearing engagement directly with the second face of the distal portion of the first blade.

17. The tool according to claim 16, wherein an area of contact between the first blade and the second blade at the distal portion of the first blade is substantially in line with an area of contact between the first blade and the peripheral part of the interface.

* * * * *